United States Patent [19]

Pruitt, Jr.

[11] 3,986,249

[45] Oct. 19, 1976

[54] METHOD AND APPARATUS FOR AFFIXING PREALIGNED CORNER POSTS TO BOX-LIKE STRUCTURES BEFORE ASSEMBLING SAME

[76] Inventor: Robert L. Pruitt, Jr., 10001 Hendrix Court, NE., Albuquerque, N. Mex. 87111

[22] Filed: Nov. 7, 1975

[21] Appl. No.: 629,772

Related U.S. Application Data

[62] Division of Ser. No. 493,763, Aug. 1, 1974.

[52] U.S. Cl. ..... 29/466; 29/464; 52/742

[51] Int. Cl.[2] ..... B23Q 3/00

[58] Field of Search..... 29/200 J, 200 P, 200 R, 29/464, 467, 469, 418, 559, 428, 465, 466; 269/40, 321 F, 321 S; 248/19, 188.8; 52/742, 23

[56] References Cited

UNITED STATES PATENTS

| | | | |
|---|---|---|---|
| 2,342,179 | 2/1944 | Ciesa et al. | 29/200 J |
| 2,391,510 | 12/1945 | Pioch et al. | 29/200 J |
| 2,669,013 | 2/1954 | Wilson | 269/321 S |
| 3,076,231 | 2/1963 | Vertin | 29/467 X |
| 3,195,312 | 7/1965 | Rumsey | 52/742 X |
| 3,691,703 | 9/1972 | Barnes | 52/23 |
| 3,714,696 | 2/1973 | Kay | 29/200 P |
| 3,839,751 | 10/1974 | Bressler | 52/742 X |

*Primary Examiner*—C.W. Lanham
*Assistant Examiner*—James R. Duzan
*Attorney, Agent, or Firm*—Edwin L. Spangler, Jr.

[57] ABSTRACT

This invention relates to a corner alignment jig for box-like structures to be joined together in side-by-side or end-to-end assembled relation which comprises four horizontally adjustable vertically-disposed prealigned stanchions positioned to receive the box-like structure therebetween, fastener means for detachably connecting a corner post to the inside planar face of each stanchion, spacer means to be interposed between each stanchion and the corner post associated therewith to maintain a fixed spaced parallel relation therebetween, and jack means for temporarily elevating the box-like structure into position to have the four corner posts fastened thereto. The invention also encompasses the method of affixing corner posts to a box-like structure in fixed spaced parallel relation to one another which includes the steps of placing the box-like structure in position such that the stanchions are located at the corners thereof, temporarily fastening a corner post to each stanchion in fixed spaced parallel relation, raising the box-like structure up into proper position relative to the corner posts, permanently fastening the corner posts to the box-like structure, detaching the corner posts from the stanchions, lowering the box-like structure and removing same with corner posts attached.

4 Claims, 9 Drawing Figures

METHOD AND APPARATUS FOR AFFIXING PREALIGNED CORNER POSTS TO BOX-LIKE STRUCTURES BEFORE ASSEMBLING SAME

This is a division of application Ser. No. 493,763, filed Aug. 1, 1974.

Multiple-room and even multilevel modular construction, while not yet in widespread use, is at least a practical reality. Construction costs are reduced considerably over "on-site" construction because of the many time and labor saving practices that can be followed in a factory that are impossible to use elsewhere. For this reason, a few of the more innovative builders are trying the technique of factory assembled rooms which are trucked to the site and assembled. Unfortunately, certain unforeseen problems have arisen which do not admit to an easy solution.

Construction at the building site permits the elements to be leveled, plumbed, shaved and shimmed as needed to produce the required fit which, once achieved, presents no further problem. Factory assembly, particularly of structures having a welded metal frame, leaves no such latitutde and if, as is the case more often than not, the adjoining substructures or modules do not match up properly, then it becomes very difficult if not impossible to make them do so. Furthermore, in large multilevel structures where modular construction is most desirable from a cost standpoint, alignment errors cannot be tolerated as they compound so that small minor errors quickly become major ones.

While many of these alignment errors are a result of imprecise assembly, others are going to exist no matter how carefully the job is done. For instance, the mill tolerances to which structural steel shapes are manufactured far exceed those that can be tolerated in a room module yet, they must be compensated for in some practical instances in an efficient fashion.

It has now been found in accordance with the teaching of the instant invention that skewed walls, unparallel surfaces, twisted and bowed frame members together with several other misaligned conditions can all be tolerated provided only that the modules are constructed to include just a few select points of attachment and that these are precisely located relative to one another. More specifically, by placing corner posts at all four corners of the room, fastening them in precisely-spaced parallel relationship to one another and keeping their mating faces essentially planar as well as parallel, then even gross distortion of the wall, ceiling and floor structure as well as disorientation thereof relative to one another can be tolerated from a structural, if not an aesthetic, standpoint. Small gaps between the corner posts and the associated frame elements of the room to which they are welded is of no consequence, especially when such discrepencies remain hidden behind or even within the walls of most modular buildings assembled therefrom.

By placing the box-like room module on a wheeled carriage preparatory to fastening the corner posts thereto, it can be moved into position between the jig stanchions rather easily, especially if the carriage is mounted on rails. If all modules are the same size, the corner alignment stanchions of the jig can be erected, trued and then fastened in place more or less permanently. In most instances, however, provision should be made for adjusting each stanchion relative to the others both to-and-fro as well as from side-to-side in order to accommodate various size modules. Even so, once the stanchions are in proper position they should be carefully anchored in place because the accuracy with which they are placed determines the alignment of the entire modular assembly.

Furthermore, it has been found that by fabricating the stanchions from considerably heavier and stouter stock than that which will be used in the corner posts, one is able to accomplish some straightening of the latter by drawing them up snug against the spacers which separate the planar machined stanchion faces therefrom. Then, by welding the corner posts to the corners of the box-like structure while they are being held in straightened condition, the improved relationship can be maintained in the finished module.

Interposing spacer elements between the stanchions and corner posts while the latter are being permanently affixed to the box-like structure creates enough of a gap when they are removed to allow the finished module to be withdrawn easily from the jig. While other release systems could obviously be substituted for the spacers, they all involve much more complicated and expensive equipment, much of which is involved in insuring that each stanchion returns to precisely the same position it formerly occupied.

It is, therefore, the principal object of the present invention to provide a novel and improved alignment jig for use in fastening corner posts to box-like room modules preparatory to connecting two or more thereof together in assembled relation.

A second objective of the within described invention is the method of using the corner alignment apparatus to place corner posts in a known precise relationship to one another.

Another object is to provide a jig of the type aforementioned which can even be used to straighten and maintain twisted and otherwise misaligned structural members being used for corner posts until they can be fastened to the box-like structure.

Still another objective of the invention herein disclosed and claimed is the provision of an alignment jig that holds the corner posts in proper position for attachment to the box-like structure regardless of the misaligned condition of the latter within tolerable limits.

Further objects are to provide a method of attaching corner posts to a room module which is fast, efficient, reliable, accurate, safe and versatile.

Still other objects are to provide an apparatus of the type forming the subject matter hereof which is rugged, easy to use, relatively inexpensive in comparison to other equipment for accomplishing the same function, strong and readily adaptable for use in attaching the corner posts to box-like structures of various sizes.

Additional objects will be in part apparent and in part pointed out specifically hereinafter in connection with the description of the drawings that follows, and in which.

Figure 1:
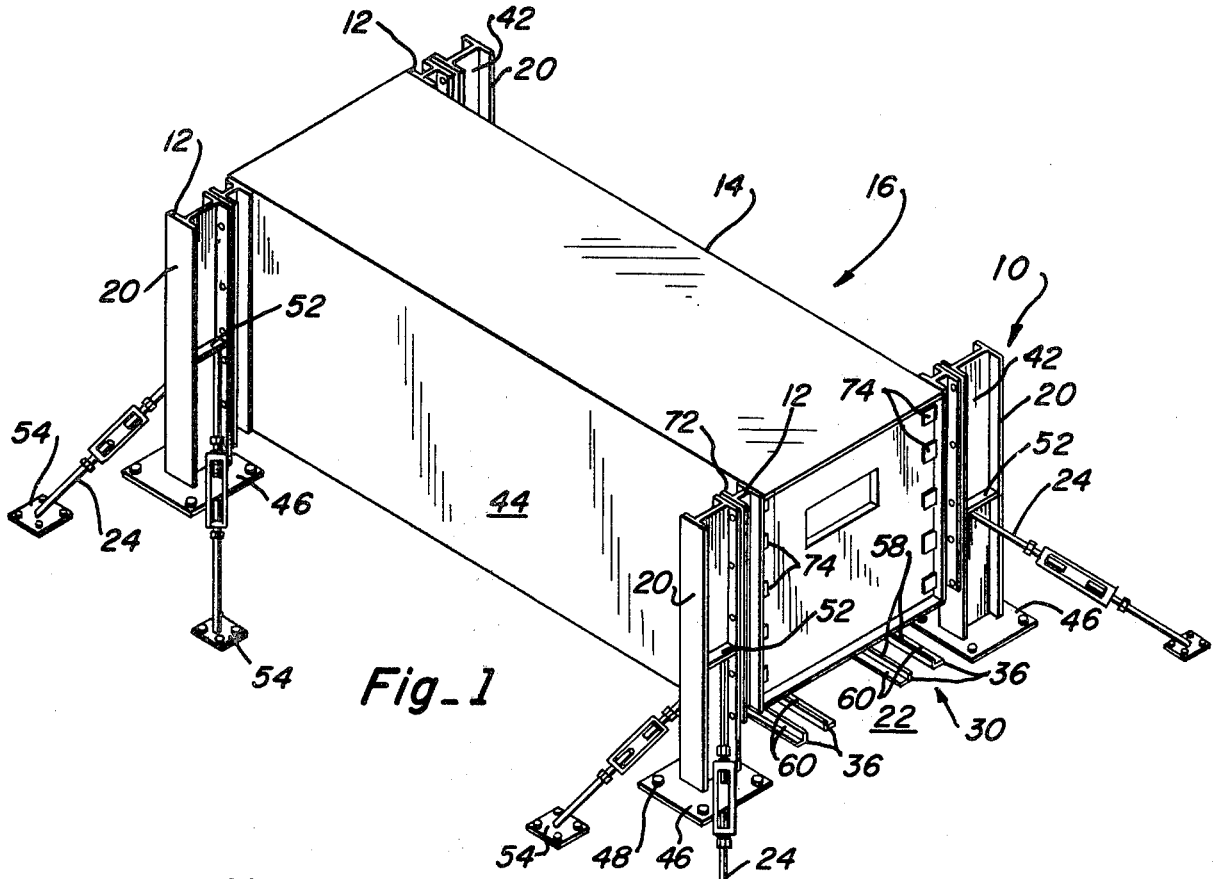
FIG. 1 is a perspective view looking down and to the left upon the corner alignment jig showing a box-like unit in place therein having the corner posts attached thereto.
Figure 2:
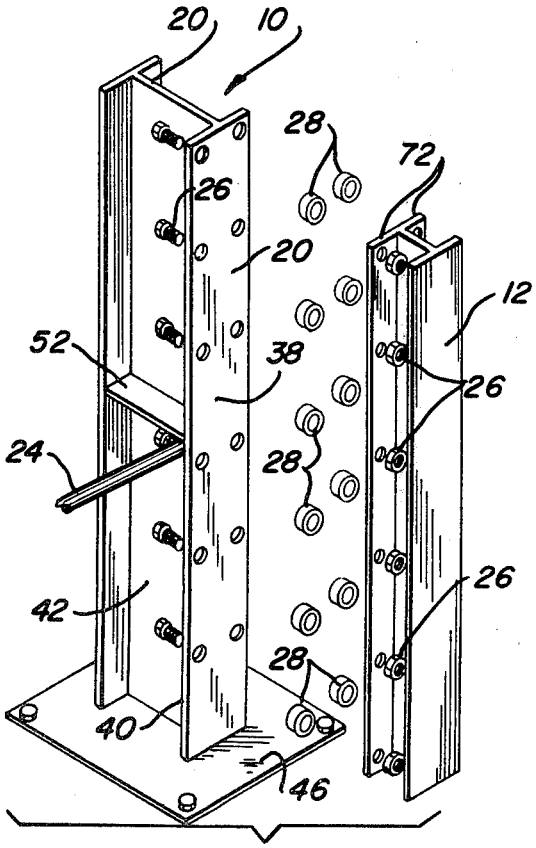
FIG. 2 is an exploded perspective view similar to FIG. 1 but to a larger scale showing a stanchion, a corner post, and the fastener and spacer subassemblies used to detachably connect them together in fixed spaced parallel relation.
Figure 3:
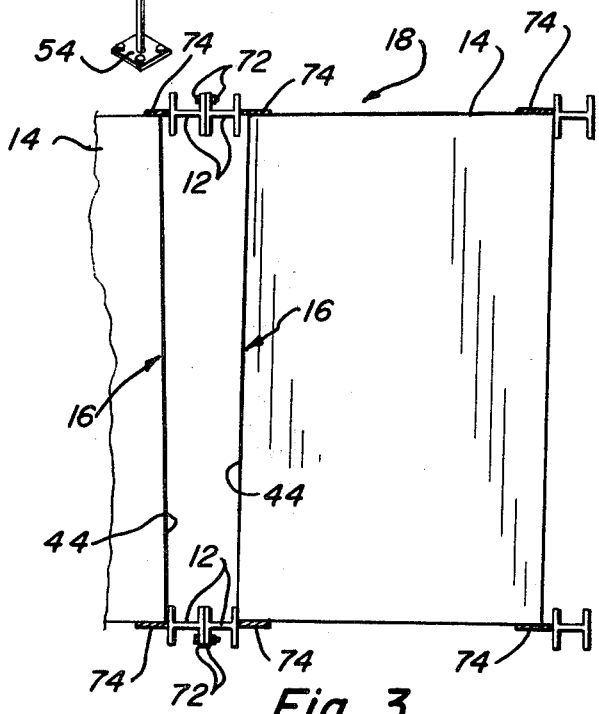
FIG. 3 is a fragmentary top plan view to approximately the same scale as FIG. 1 showing how the properly aligned corner posts can be used to connect two or more of the box-like members together in properly assembled relation even though the walls of the latter are grossly misaligned.
Figure 4:
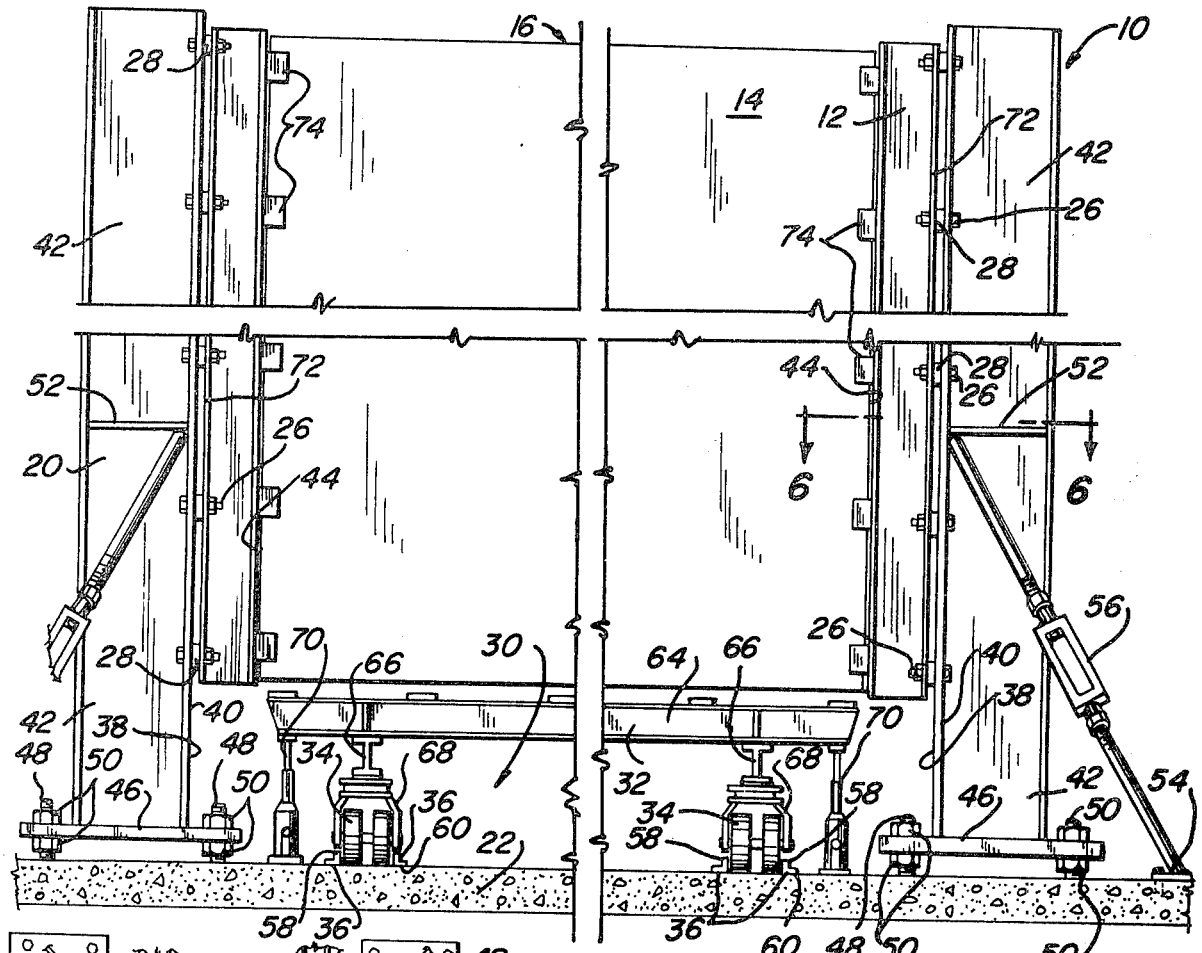
FIG. 4 is a front elevation to approximately the same scale as FIG. 2 showing the complete assembly including the alignment jig, the corner posts, spacers, jacks, and box-like member, portions having been broken away to conserve space.

Referring next to the drawings for a detailed description of the present invention and, initially, to FIG. 1 for this purpose, reference numeral 10 has been selected to broadly designate the corner alignment jig by means of which the corner posts 12 are permanently fastened in fixed-spaced parallel relation to the corners of a box-like structure 14 which then becomes a module generally indicated by numeral 16 capable of being joined to other such modules to form an assembly of the type shown in FIG. 3 and indicated in a general way by numeral 18. Jig 10 includes at least four upright stanchions 20 which are either fixedly attached to the floor 22 as shown in FIG. 4 or, alternatively, adjustably mounted thereon in the manner of the embodiment of FIGS. 7, 8 and 9. These stanchions are maintained in a precise vertical position by adjustable ground anchored struts 24 which, together with bolts 26 and spacers 28 (FIGS. 2, 4, 5 and 6) complete the corner-forming jig.

While it forms no part of the corner-forming jig 10 and, in fact, the jig can be used without it; nevertheless, a useful accessory is the rail-mounted carriage subassembly that has been broadly designated by reference numeral 30 and which can be seen in FIG. 4 to include the carriage frame 32, heavy duty yoke-mounted dual wheels 34 supporting same, and a track consisting of two sets of parallel rails 36 mounted on the floor 22. This wheeled carriage subassembly is quite useful in transporting the box-like structure 14 into position between the corner posts 12 fastened to the stanchions as well as for moving the completed module 16 out of the way again.

About the only other necessary accessory requiring specific mention is some type of apparatus capable of raising the box-like structure 14 up to the proper height for attaching the corner posts 12 thereto. One such means has been illustrated and will be identified further presently in connection with a detailed description of FIG. 4. Whatever means is used, it must be capable of moving the box-like structure relative to the corner posts which are detachably connected to the stanchions in a relatively fixed position.

Referring next to FIGS. 1–6, inclusive, of the drawings, it will be seen that each of the four stanchions 22 comprises, in the particular form shown, an I-beam having the face 38 of flange 40 remote from the web 42 ground off to produce a truly planar surface. Then, the stanchion is mounted such that this planar surface 38 faces inwardly toward the adjacent sidewall 44 of the box-like structure 14. Each such stanchion has a base-plate 46 at the foot thereof which is permanently anchored in the floor 22 with studs 48. Nuts 50 positioned both above and below the base plate on these upstanding studs provide adjustable abutments by means of which the tilt of the stanchion can be adjusted to place the planar face 38 thereof in a truly vertical position.

Horizontally-disposed gusset plates 52 are welded into the channels on opposite sides of the I-beam stanchions to provide anchor points for the attachment of the upper extremities of struts 24, the lower ends of which are welded or otherwise attached to anchor plates 54 bolted into the floor. In the particular form shown, these struts are two piece rods, the adjacent ends of which are interconnected by a turnbuckle 56 that is used to tension same and maintain the planar face 38 vertical. As shown, these struts diverge from opposite sides of the web 42 at approximately a 45° angle to the latter thus placing them in perpendicular relation to one another.

The four stanchions are so positioned and adjusted that the planar faces 38 of the two stanchions on each side are both vertical and coplanar. In addition, the coplanar surfaces thus defined lie in fixed, spaced parallel relation to one another leaving a gap therebetween adequate to loosely pass the sidewalls 44 of the box-like structure therebetween and still leave room for both the corner posts 12 and the spacers 28. Furthermore, while not especially critical, the webs 42 of the stanchions on the same end should occupy an essentially coplanar relationship to one another with the plane defined thereby extending perpendicular to the plane of their respective planar faces 38.

Figure 5:
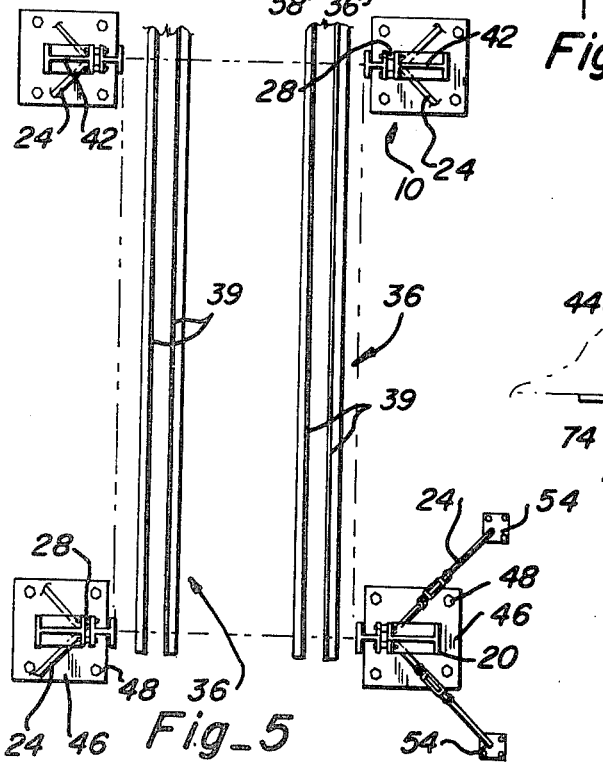
FIG. 5 is a fragmentary top plan view to a reduced scale showing the corner forming jig, rails and corner posts in position to receive the box-like structure.
Figure 6:
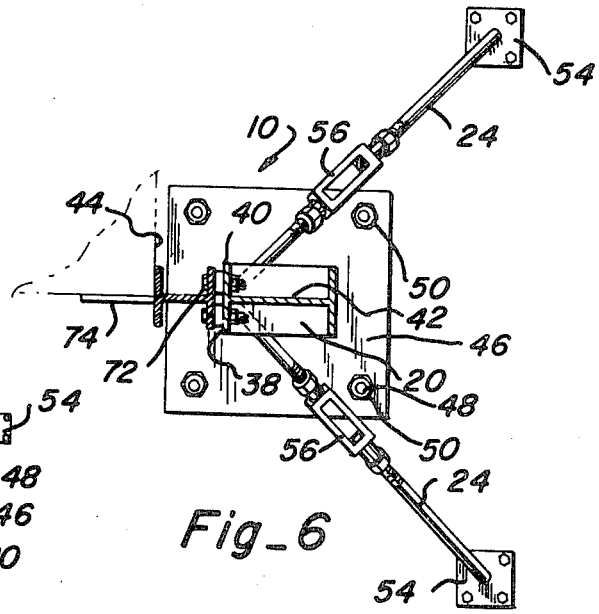
FIG. 6 is a fragmentary section to an enlarged scale taken along line 6—6 of FIG. 4.

In FIGS. 1, 4 and 5, it can be seen that the track 36 has parallel rails 39, each of which is formed from a pair of angle irons laid such that two of the flanges 58 extend vertically in spaced parallel relation to one another while the remaining flanges 60 extend along the floor horizontally in opposite directions. The wheels 34 of the dolly or carriage 32 do not ride atop the rails as is usually the case, but rather, between the upstanding flanges 58 thereof which cooperate to define a guideway.

With specific reference to FIG. 4, it will be noted that the carriage has cross frame members 64 connected together by longitudinally-extending frame members 66 to the underside of which are attached the wheel-carrying yokes 68. This carriage supports the box-like structure while it is being fabricated as well as during its movement in and out of the corner-forming jig. Its prime function, however, is to provide the means for transporting the latter and placing it in proper position within the corner-forming jig to have the corner posts 12 mounted on the corners thereof. Note, however, that during the actual operation of mounting the corner posts on the box-like structure, the carriage is lifted free of the tracks on suitable elevating means, the particular one shown comprising several jacks 70. By using jacks as opposed to elevating mechanisms which are less controllable, the box-like structure can be positioned rather precisely between the corner posts to be attached thereto. Moreover, jacks have an advantage over a purely vertical lift elevating mechanism in that they are individually adjustable to produce a degree of tilt impossible to realize with the latter. Such adjustments, while not absolutely necessary, are helpful in order to maintain the sidewalls of the box-like structure nearly parallel to and about the same distance away from the corner posts.

Looking next at FIG. 2, it can be seen that the corner posts 12 are attached to the stanchions 20 by bolting their pre-drilled flanges 72 to the planar face 38 of the latter. Spacers 28 are placed between the opposed surfaces of these two upright members preparatory to drawing them up tight with the bolt and nut fasteners 26. In so doing, some straightening of the corner posts is accomplished, especially with respect to flange 72 which is the mating flange that will be joined to another like flange of the adjoining module, the condition of the web and remaining flange being relatively unimportant so long as they start out and remain reasonably straight.

In large box-like structure such as modularized rooms, the spacers become necessary in order to free up the finished module from the corner alignment jig 10 so that it can be removed from the latter without binding. Obviously, smaller box-like structures of a size that could be manipulated by hand, for example, would not create the binding problems, therefore, in such instances the corner posts could be fastened directly to the stanchions without having to interpose the spacers therebetween.

Next, the box-like structure 14 is rolled into position on the wheeled carriage subassembly 30. Then the corner posts are temporarily fastened in place to the stanchions as shown in FIG. 5. Jacks 70 are then moved into position beneath the carriage as shown in FIG. 4, whereupon, the box-like structure together with the carriage are hoisted free of the tracks into proper position alongside the corner posts. The final assembly operation consists of permanently fastening the corner posts to the corners of the box-like structure by means of welded plates 74. Once this is done, the faces of the drilled flanges 72 on the same side of the module thus formed will be essentially coplanar and parallel to the coplanar flange surfaces on the opposite side.

While still supported on the jacks, the fasteners 26 and spacers 28 are removed to detach the corner posts from the stanchions of the jig. Then, the completed module is lowered back down onto its tracks and removed to another location.

FIG. 3 to which reference will now be made shows how two such modules 18 are fastened together in side-by-side assembled relation. Note that regardless of the position the corner posts occupy with respect to the sidewalls and end walls of the room, their drilled flanges match up perfectly so that they can be bolted together as shown. Not only are the mating faces of the corner posts to be joined together essentially planar, but the holes drilled therein match up when the two structures are in proper position. While not illustrated, the modules can also be stacked one atop another as the corner posts will all be vertical once any one of them is placed in such a position. The units can even be assembled in end-to-end relation by welding the adjacent edges of the drilled flanges together in side-by-side parallel relation.

Figure 7:
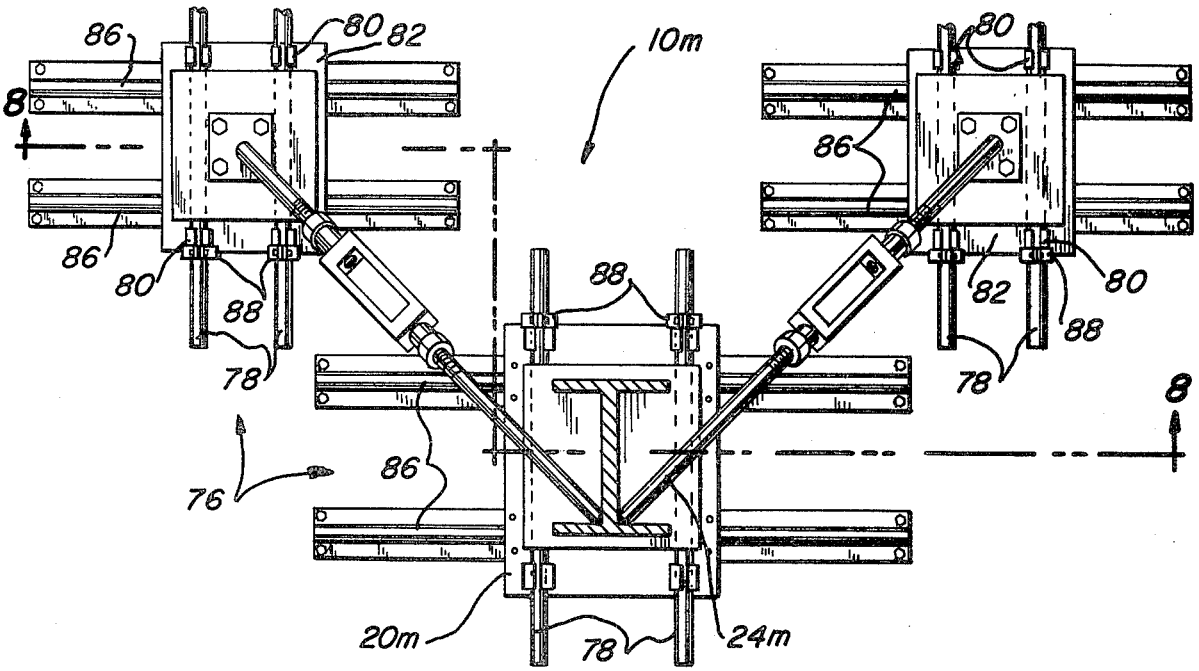
FIG. 7 is a fragmentary horizontal section similar to FIG. 6 showing a modified form of jig stanchion wherein said stanchion together with its anchoring struts are adjustable both side-to-side and to-and-fro.
Figure 8:
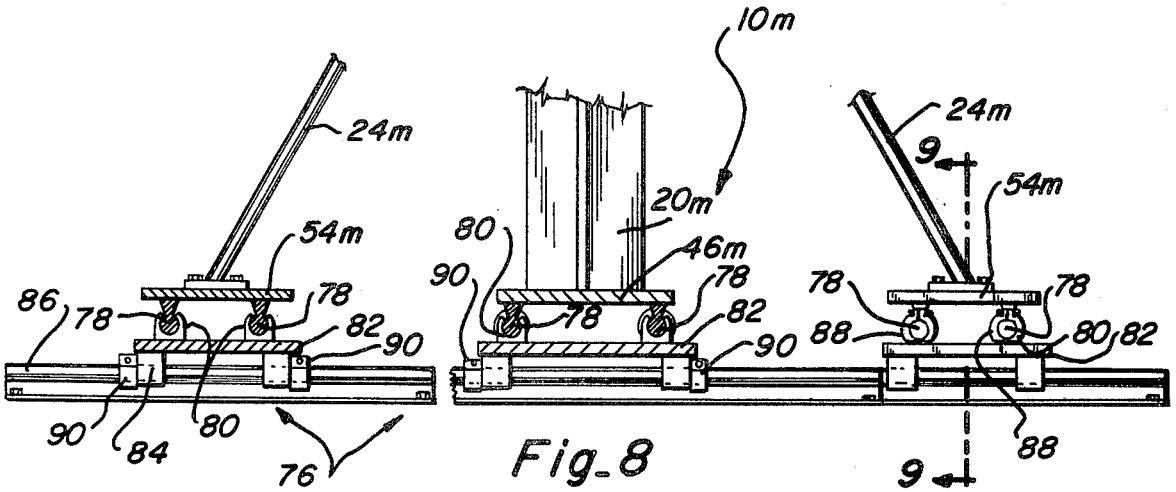
FIG. 8 is a section taken along line 8—8 of FIG. 7.
Figure 9:
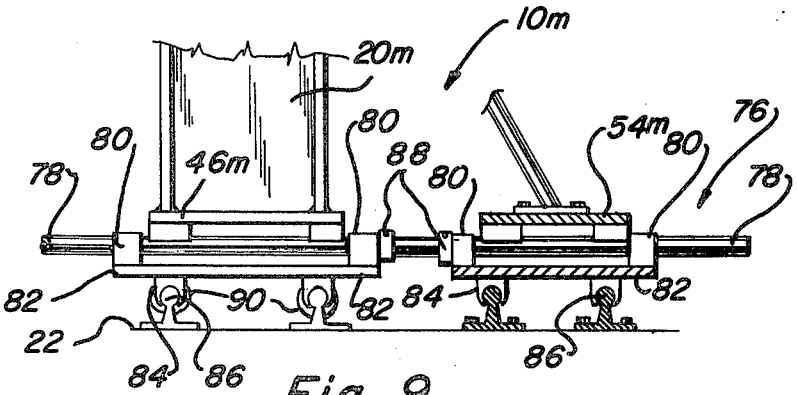
FIG. 9 is a section taken along line 9—9 of FIG. 8.

FIGS. 7, 8 and 9 to which reference will now be made show a modified form of corner-forming jig 10*m* which differs from that just described in connection with FIGS. 1–6, inclusive, in that it has longitudinally and laterally adjustable stanchions 20*m* and braces 24*m*. For all practical purposes, the stanchions and braces therefor remain exactly the same except for the fact that the base plate 4*m*atop which the stanchions are mounted and the anchor plates 54*m* at the lower ends of the braces are mounted on a track subassembly which has been designated broadly by reference numeral 76.

This track subassembly is old in the art, one form thereof being sold by Thomson Industries, Inc. of Manhasset, New York and illustrated in example 4 of FIG. 19 on page 19 of its 1970 catalog entitled "Thomson Ball Bushings." Essentially, spaced parallel shafts 78 are fastened by means of suitable brackets to the underside of bed plates 46*m* and anchor plates 54*m* as shown. These shafts are, in turn, cradled in slit bearing saddles 80 mounted on top of sliding carriages 82. Four such saddles are used atop each carriage arranged in pairs to accept the shafts 78 for linear rolling movement in one direction.

The underside of the carriage 82 carries other slit bearing saddles 84 in inverted position that ride atop parallel rails 86 that extend at right angles to the shafts 78 or longitudinally as illustrated. Thus, each stanchion together with its anchoring braces is mounted for limited universal movement in a horizontal plane so as to accommodate modules of different lengths and widths. Once positioned, collars 88 are fastened to the shafts and clamps 90 to the rails so as to maintain the stanchions in their adjusted positions. Other forms of linear adjustment mechanism can, of course, be substituted for the one shown as it is intended as being merely illustrative of one such mechanism that could be used.

I claim:

1. The method of mounting corner posts in fixed spaced parallel relation to one another on the corners of a box-like structure which includes the steps of: positioning four upright stanchions at the corners of the box-like structure so as to have a gap between the sidewalls of the latter and the adjacent stanchions surface, providing said adjacent stanchion surfaces with a vertically-disposed planar face lying in essentially coplanar relation to the corresponding planar face of the stanchion on the same side thereof and in opposed face-to-face parallel relation to the planar face of the similarly-positioned stanchion of the pair on the opposite side, placing a corner post in the gap left between the planar face of each stanchion and the opposed sidewall surface of the box-like structure, temporarily fastening each corner post to the adjacent planar face of each stanchion in vertically-disposed substantially parallel relation thereto; permanently fastening each corner post to the adjacent sidewall surface of the box-like structure, detaching the corner posts from their respective stanchions, and removing the box-like structure with corner posts attached from between said stanchions.

2. The method as set forth in claim 1 which includes the step of leaving a gap between the corner post and the planar face of the stanchion to which it is fastened.

3. The method as set forth in claim 2 which includes the step of straightening the corner posts by drawing them into parallel relation with the planar face of the stanchions to which they are attached.

4. The method as set forth in claim 1 which includes the step of inserting spacers between the corner posts and stanchions to maintain a minimum fixed spaced relation therebetween.

* * * * *